US005594446A

United States Patent [19]

Vidmar et al.

[11] Patent Number: 5,594,446

[45] Date of Patent: Jan. 14, 1997

[54] BROADBAND ELECTROMAGNETIC ABSORPTION VIA A COLLISIONAL HELIUM PLASMA

[75] Inventors: Robert J. Vidmar, Stanford; Donald J. Eckstrom, Portola Valley; Joseph J. Eash, San Carlos; Walter G. Chestnut, Foster City, all of Calif.

[73] Assignee: SRI International, Menlo Park, Calif.

[21] Appl. No.: 149,574

[22] Filed: Jan. 28, 1988

[51] Int. Cl.[6] ..... H01Q 17/00

[52] U.S. Cl. ..... 342/1

[58] Field of Search ..... 315/85, 111.21, 315/111.81; 342/1, 169, 170

[56] References Cited

U.S. PATENT DOCUMENTS 4,621,265 11/1986 Buse et al. ..... 342/169

4,786,844 11/1988 Farrell et al. ..... 315/111.21

*Primary Examiner*—Theodore M. Blum

*Attorney, Agent, or Firm*—Edward E. Davis; Francis H. Lewis

[57] ABSTRACT

A system (20) for broadband electromagnetic absorption in an anechoic chamber (22) has walls (24) of the chamber (22) forming a sealed space. A plurality of ionization sources (30) are mounted on an inside surface of the walls (24), facing the sealed space (28), with a spacing to give one ionization source/$m^2$ of chamber (22) surface. An electron beam source (32) is connected to the ionization sources (30). A source (36) of helium gas is connected to supply the helium to the space (28). An electronic unit (42) under test is inside the anechoic chamber, and is connected to a test system (44). The test system (44) is also connected to the electron beam source (32). The ionization sources (30) generate a helium plasma in the space (28) by pulsed operation of the electron beam source (32). Timing signals are supplied by the synchronizer (52) to electron-beam source (32) and to the test system (44), so that test signals are supplied by the test system (44) to the unit (42) under test and outputs from the unit (42) are supplied to the test system (44) during an approximately 200 μsecond low-noise portion of the helium plasma afterglow following energization of the ionization sources (30). Electromagnetic waves generated by the unit (42) in the chamber (22) during the test are absorbed by the helium plasma, so that the outputs from the unit (42) do not include any substantial interference from reflected electromagnetic waves in the chamber (22).

20 Claims, 5 Drawing Sheets

*FIGURE 1* *ELECTRON LIFETIME IN A HELIUM-AIR MIXTURE*

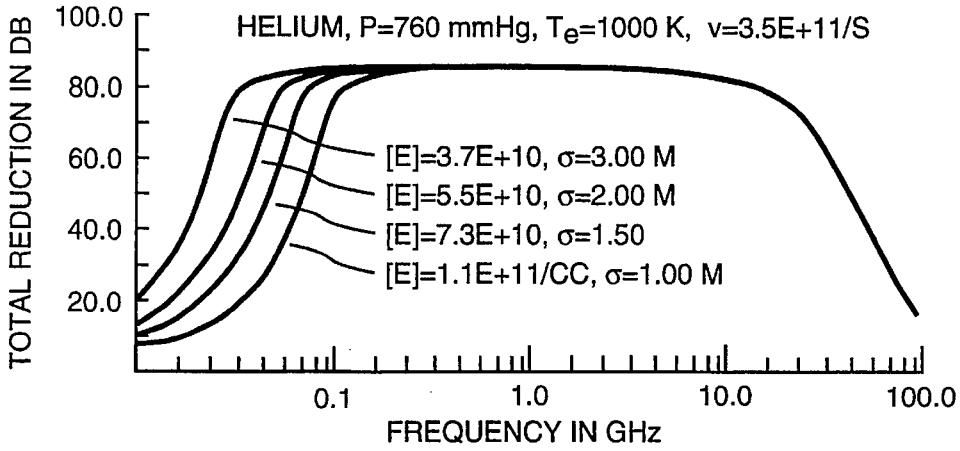
*FIGURE 4* *PERFORMANCE AT 760 mm Hg*
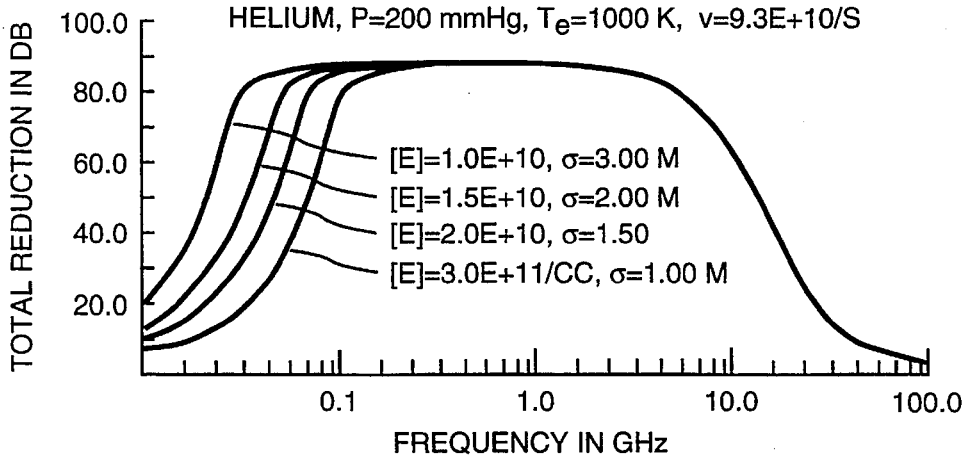
*FIGURE 5* *PERFORMANCE AT 200 mm Hg*
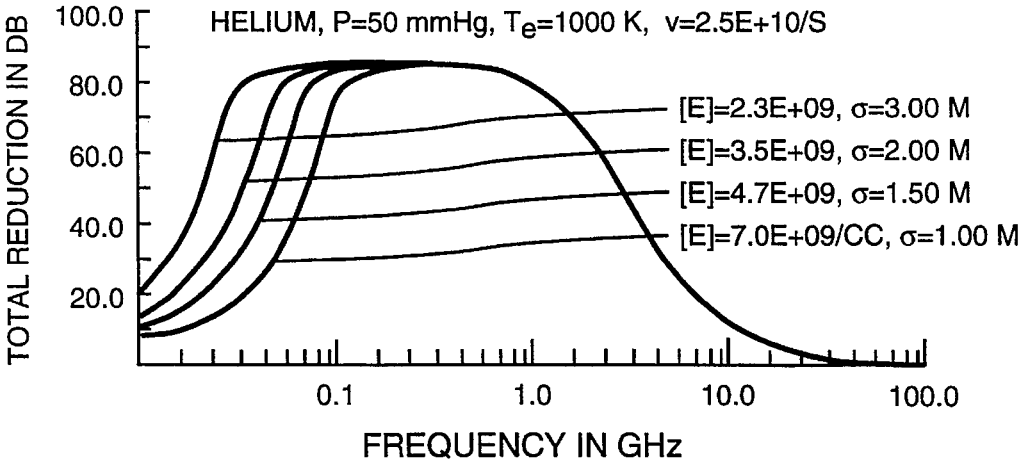
*FIGURE 6* *PERFORMANCE AT 50 mm Hg*

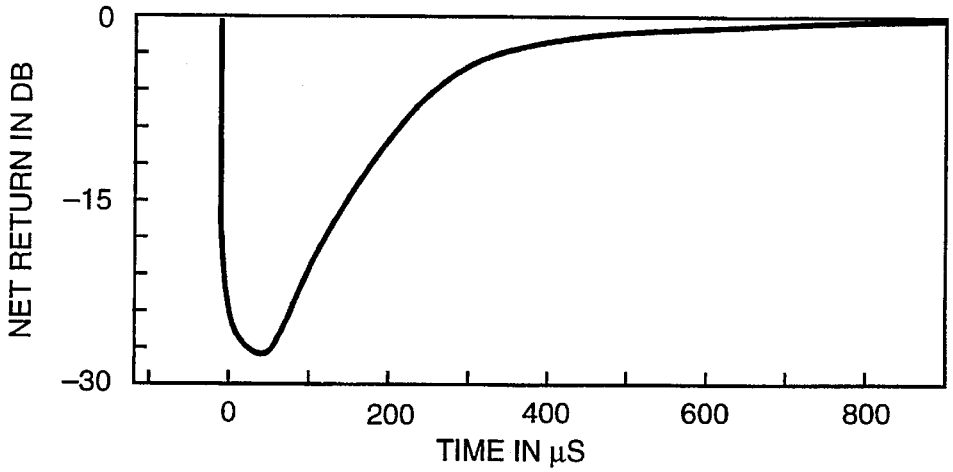
*FIGURE 7* *REFLECTIVITY OF A HELIUM AFTERGLOW AT 700 mm Hg*
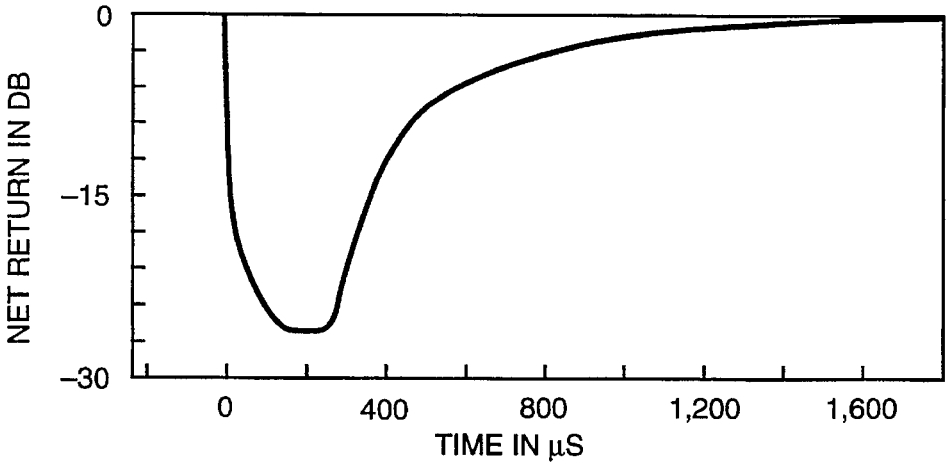
*FIGURE 8* *REFLECTIVITY OF A HELIUM AFTERGLOW AT 200 mm Hg*
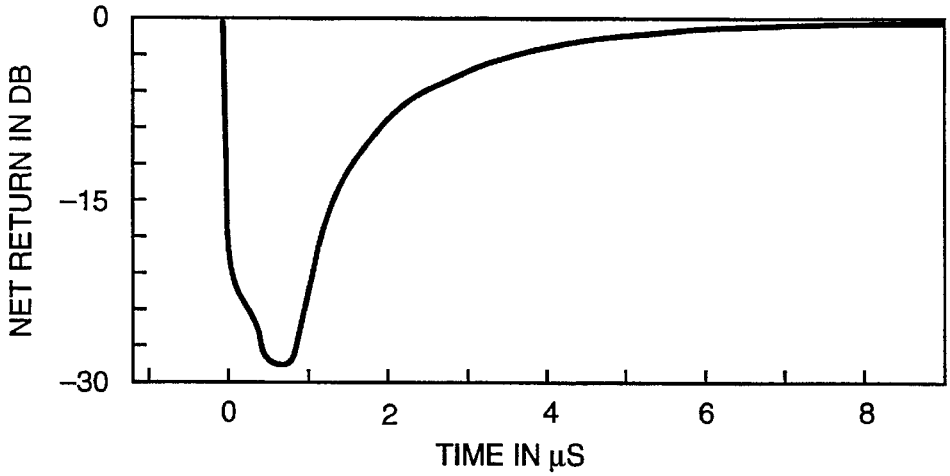
*FIGURE 9* *REFLECTIVITY OF A HELIUM AFTERGLOW AT 50 mm Hg*

BROADBAND ELECTROMAGNETIC ABSORPTION VIA A COLLISIONAL HELIUM PLASMA

ORIGIN OF THE INVENTION

This invention was made under a Government contract with the United States Air Force Office of Scientific Research, Contract F49620-85-K-0013, and the Government therefore has rights under the invention described and claimed herein.

BACKGROUND OF THE INVENTION

1. Field of the Invention

This invention relates to a system and a process for absorbing electromagnetic waves over a broad frequency range. More particularly, it relates to such a system and process which is effective over a range of frequencies of from about 100 megahertz (MHz) through 10 gigahertz (GHz). Most especially, it relates to such a system and process which is effective at the very high frequency (VHF) range.

2. Description of the Prior Art

A remarkable property of ionized gas is its ability to attenuate electromagnetic waves. This wave absorption is broadband if the gas exists at atmospheric pressure. Basic theoretical studies predicting broadband electromagnetic absorption have already been done. For example, M. Mitchener and C. Kruger, *Partially Ionized Gases*, Chapter III, (Wiley, 1973) predict broadband electromagnetic absorption for a cold collisional plasma. W. G. Chesnut, "Radar Reflection Coefficients From a Plasma Gradient With Collisions" , pp. 96, Special Report 10, prepared for DASA, Contract DA-49-146-XZ-184, (October, 1968), discloses that an electron density that varies smoothly is necessary to maximize absorption and minimize radiation backscatter. K. G. Budden, *The Propagation of Radio Waves*, Chapter 15 (Cambridge, 1985), provides theoretical models for estimating the power reflection coefficient from collisional plasma gradients.

Observations of naturally occurring collisional plasmas verify the theoretical predictions. For example, N. C. Gerson, *Radio Wave Absorption in the Ionosphere*, pp. 379, (Pergamon Press, 1962) discloses D-layer deviative and non-deviative absorption of high frequency (HF) electromagnetic waves. S. Glasstone and P. J. Dolan, *The Effects of Nuclear Weapons*, Chapter X, (U.S. DOD and ERDA, 1977), discloses radio and radar interference effects of collisional plasmas produced by the detonation of nuclear explosive devices in the atmosphere. M. Gunar and R. Mennella, "Signature Studies for a Re-Entry System," *Proceedings of the Second Space Congress—New Dimensions in Space Technology*, pp. 515–548, Canaveral Council of Technical Societies, (April, 1965), discloses fluctuations in re-entry vehicle RCS at 60,000 feet and the communications blackout of these vehicles during re-entry due to a collisional plasma formed around the vehicles.

Some studies have been carried out specifically with helium plasmas. Y Itikawa, "Effective Collision Frequency of Electrons in Gases," *The Physics of Fluids*, vol. 16, No. 6, pp. 831–835, (June, 1973), provides estimates of helium momentum-transfer collision rates. Note that there is a typographical error in Table II, $10^{-18}$ should be $10^{-8}$ $sec^{-1}$ $cm^3$. R. Deloche, R. P. Monchicourt, M. Cheret and F. Lambert, "High Pressure Helium Afterglow at Room Temperature," *Physical Review A*, Vol. 13, No. 3, pp 1140–1176, (March, 1976), discuss theoretical and experimental investigations of the helium recombination process.

While a substantial amount of study has thus been carried out with collisional plasmas, including their property of attenuating electromagnetic waves, practical use of this phenomenon has not occurred.

Anechoic chambers conventionally employ projecting bodies of foam absorbing material mounted on the walls of such chambers. These absorbing materials are effective for absorbing higher frequency electromagnetic waves, such as in the UHF range, but they are less effective for lower frequencies, such as the VHF range. For effective absorption, lower frequencies would require projections of the foam absorbing material which are too large for ready mounting on the walls of the chamber.

SUMMARY OF THE INVENTION

Accordingly, it is an object of this invention to provide a system and process for attenuating electromagnetic waves which is effective at electromagnetic wave frequencies of from about 100 MHz through about 10 GHz.

It is another object of the invention to provide such a system and process which makes practical use of the broadband electromagnetic wave absorption of a collisional plasma.

It is another object of the invention to provide such a system and process in which the collisional plasma is generated intermittently.

The attainment of these and related objects may be achieved through use of the novel system and process for attenuating electromagnetic waves herein disclosed. A system in accordance with this invention has a vessel for confining a body of helium gas and a means for supplying helium gas to the vessel. At least one ionization source is coupled to the vessel for ionizing the helium gas to produce a plasma. The ionization source is preferably powered to supply ionizing energy to the helium gas intermittently. The process for absorbing an electromagnetic wave of this invention includes confining a body of helium gas. The body of helium gas is ionized to produce a plasma. The electromagnetic wave is absorbed with the plasma of the body of helium gas. The body of helium gas is preferably ionized by supplying ionizing energy to the body of helium gas intermittently.

The attainment of the foregoing and related objects, advantages and features of the invention should be more readily apparent to those skilled in the art, after review of the following more detailed description of the invention, taken together with the drawings, in which:

BRIEF DESCRIPTION OF THE DRAWINGS

FIGS. 4–6 are graphs of chamber performance vs. frequency for helium pressures of 760, 200 and 50 Torr.

FIGS. 7–9 are plots of waveguide absorption at helium pressures of 700, 200 and 50 Torr.

DETAILED DESCRIPTION OF THE INVENTION

A. Electromagnetic Absorption

Figure 1:
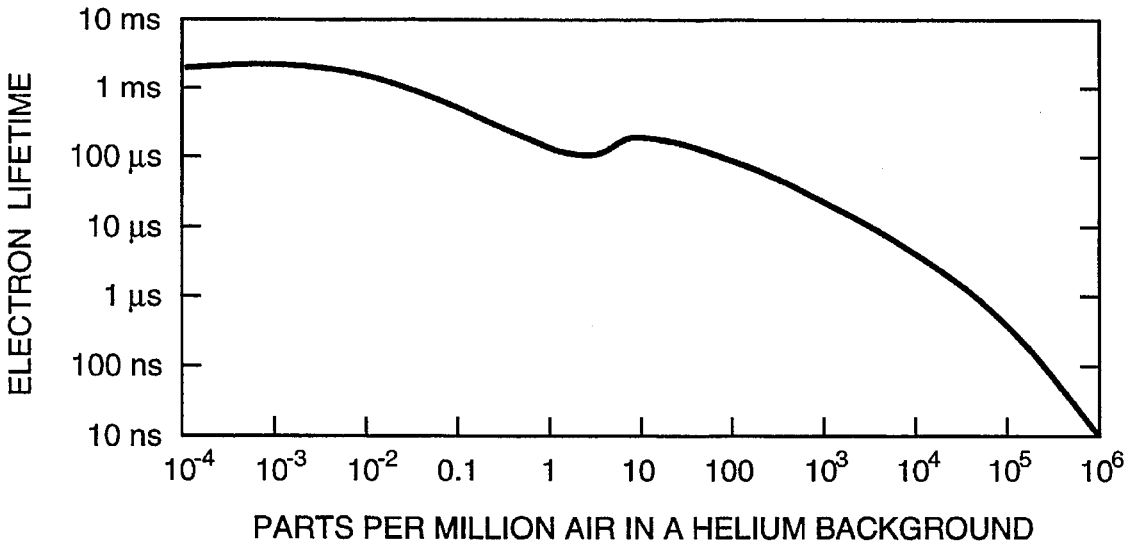
FIG. 1 is a plot of electron lifetime against parts per million air in a helium-air mixture, useful for understanding the invention.

Before turning to the drawings, a brief background discussion of electromagnetic absorption in a collisional plasma will facilitate understanding of the invention. Electromagnetic absorption in a collisional ionized gas or plasma results from the sequential conversion of electromagnetic wave energy to electron kinetic energy and then to neutral gas kinetic energy. The electromagnetic energy converted to gas kinetic energy effectively heats the gas via Joule heating. The energy so converted is permanently removed from the wave.

1. Conversion of Wave Energy to Electron Kinetic Energy

As an electromagnetic wave propagates through a plasma, the electric field of the wave accelerates the charged species in the plasma. The electric field, E, imposes a force on a charged specie given by $F=m\,a=qE$, where m, a, and q are the mass, acceleration, and charge of the specie, respectively. For an electromagnetic wave that is proportional to $\exp(i\omega t)$, the velocity of a charge carrier is $v=qE/(i\omega m)$. And, the maximum kinetic energy of a charged specie is $K_{max}=q^2E^2/(2m\omega^2)$. For a given E and $\omega$ the lightest charge carrier gains the most energy. Hence, the primary transfer of energy is from the wave to free electrons.

2. Conversion of Electron Kinetic Energy to Heat

Electrons driven by an electric field accelerate and radiate their energy back to the electromagnetic wave. For the radiation process to be efficient, the phase relationship between the electric field and the electron velocity must be +90°. In a collisionless plasma where electrons never collide with other species, the phase relationship is exactly +90°. The electron kinetic energy varies from 0 to $K_{max}$ to 0 as the electron oscillates in the driving electric field. As the electron accelerates it gains energy from the field. When it decelerates, it loses energy and the field gains it back. If the electron motion is disrupted, the electron is no longer synchronized to the electromagnetic wave. The wave loses energy.

A powerful mechanism to disrupt the electron motion is a momentum transfer collision between an electron and a neutral gas specie. At atmospheric pressure the probability of a momentum-transfer collision is high. For example, a plasma existing a sea level pressure has a momentum-transfer collision rate, $\nu$, of $425\times10^9$ collisions/sec for air and $354\times10^9$ collisions/sec for helium.

The result of each collision is the transfer of some momentum from the electron to the background gas. This transfer of momentum implies a transfer of energy from the wave to the background gas. The energy exchange per collision from the electron to the neutral gas is small. The energy exchange, $\Delta K$, is of the order of $2(m_e/m_n)K_o$, where $m_e$ and $m_n$ denote the electron and neutral gas mass, and $K_o$ is the electron energy before the collision. For air the fraction of energy lost per collision, $\Delta K/K_o$, is $40\times10^{-6}$, and for helium it is $270\times10^{-6}$.

At atmospheric pressure, where the momentum transfer collision rate is high, the transfer of wave energy to the neutral background gas can become appreciable. It is significant if the electron number density, $n_e$, is high enough to compensate for the small transfer of energy per electron from the wave to the background gas. As the electron density increases the fraction of wave energy transferred to the background gas increases. One common measure of the electron number density is the plasma angular frequency, $\omega_p=2\pi f_p=(n_e e^2/m_e\epsilon_o)^{1/2}$, where e is the electron charge and $\epsilon_o$ is the permittivity in MKS units. Conditions that favor electromagnetic absorption are (1) several collisions per cycle, $\nu>\omega$, and (2) a wave frequency, f, greater than the plasma frequency, $f>f_p$.

3. Dispersion Relation

Plasma physicists derive the absorption coefficient for a plasma from the dispersion relation for the plasma. The dispersion relation, $D(\omega,k)=0$, relates the angular frequency and wavenumber, k, to plasma parameters. For a cold collisional plasma, the dispersion relation is $$k(\omega)=\frac{\omega}{c}\left[1-\frac{\omega_p^2}{\omega(\omega-i\nu)}\right]^{1/2} \tag{1}$$

As a wave propagates through a collisional plasma, it attenuates as $E(t,z)=E_o\exp[+i(\omega t-k_r z)]\exp(-k_i z)$, where $k_r$ and $k_i$ denote the real and imaginary parts of k in (1). The attenuation coefficient is $k_i$.

B. Electron Lifetime and Helium Purity

Two fundamental processes limit the lifetime of a free electron: electron-ion recombination and electron attachment to neutral species that form negative ions. A plasma generated in air consists primarily of electrons, positive nitrogen ions ($N_2^+$ and $N_4^+$), nitrogen, and oxygen. Electrons recombine with $N_2^+$, $N_4^+$ and $O_4^+$ via two-body and three-body processes, for example, $$N_2^++e\rightarrow N+N \tag{2}$$

$$N_2^++e+e\rightarrow N_2+e \tag{3}$$

Similar reactions also exist for $N_4^+$, $O_2^+$ and $O_4^+$. Electrons also form negative ions such as $O_2^-$ via $$e+O_2+O_2\rightarrow O_2^-+O_2 \tag{4}$$

Air chemistry simulations of electron lifetime in air at atmospheric pressure suggest the time for the electron density to decrease by a factor of 1/e is 12 ns.

The electron lifetime is also a function of the electron number density, the reaction in (3) is three-body electron positive-ion recombination. Whereas the speed of reaction (2) is proportional to $n_e$, the speed of reaction (3) is proportional to $n_e^2$. The three-body reaction rate for (3) is relatively insensitive to the positive-ion specie, because the electron is the third body. For electron concentrations less than $10^{19}$ $m^{-3}$ three-body electron recombination is not important. Above $10^{20}$ $m^{-3}$, three-body electron recombination limits the electron lifetime to a few ns. For the plasmas discussed in this application, the electron concentration does not need to exceed $10^{19}$ $m^{-3}$.

The electron lifetime can be significantly extended by selecting a noble gas (which cannot form negative ions), thereby eliminating a major source of electron attachment. By selecting a noble gas with the smallest two-body positive-ion electron recombination coefficient, the loss of electrons can be minimized. Helium has the lowest recombination coefficient of the noble gases surveyed.

The lifetime for electrons in a helium-air mixture increases over five orders of magnitude in FIG. 1 as the air concentration in the mixture decreases. A helium plasma with 100 parts per million (ppm) air as an impurity has an afterglow of 100 μsec. This afterglow is long enough to conduct a variety of electromagnetic measurements, such as backscatter, and to allow use of a helium plasma in an intermittently powered system for broadband electromagnetic absorption of this invention.

The helium plasma is unique in that it has the lowest electron-ion recombination rate for gases and does not suffer from accelerated recombination due to dimer or trimer ion formation. A helium plasma with an electron density of $6\times10^{-16}$ $m^{-3}$ operating at a fraction of atmospheric pressure with a collision rate of $-40\times10^{9}$ $s^{-1}$ can attenuate waves from 30 MHz to 10 GHz. Attenuation of the order of 20 dB per meter with a power to maintain the plasma of the order of 500 $W/m^3$ can be achieved. The mechanism to generate the plasma is an electron beam with an energy of the order of 100 keV and a beam current of the order of 5 mA per cubic meter of helium plasma.

Figure 2:
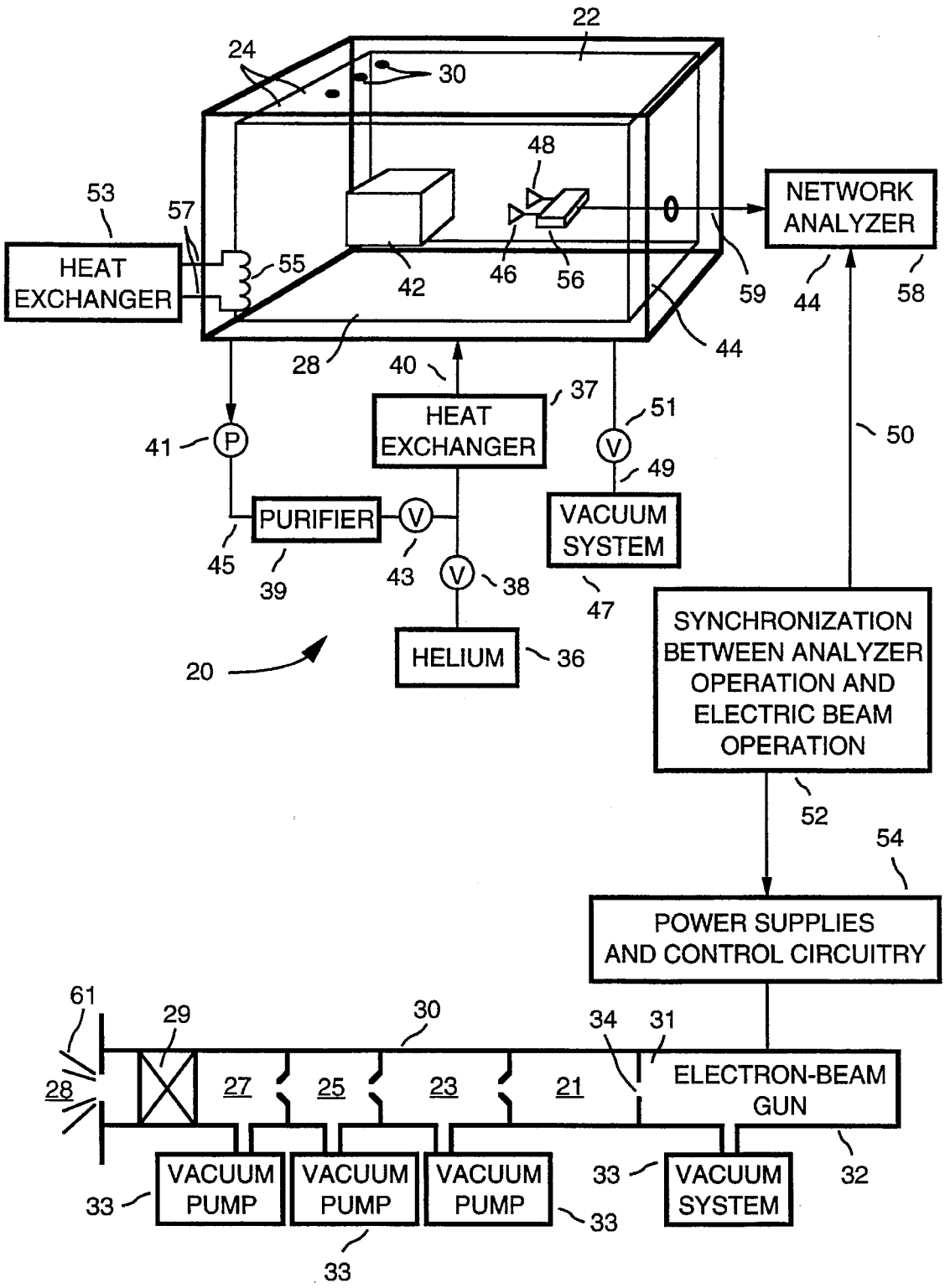
FIG. 2 is a block diagram of an electromagnetic wave absorption system in accordance with the invention.

FIG. 2 shows a system 20 for broadband electromagnetic absorption in an anechoic chamber 22. Walls 24 of the anechoic chamber 22 may be constructed from a vacuum vessel for operation below atmospheric pressure, or they may be defined by a flexible membrane, such as Kapton polyimide, for operation near atmospheric pressure without a vacuum vessel. The chamber has overall dimensions of about 40 ft.×20 ft.×20 ft. A plurality of ionization sources 30 are mounted on an inside surface of the walls 24, facing sealed space 28, with a spacing to give one ionization source/$m^2$ of chamber 22 surface. An electron beam source 32 is connected to the ionization sources 30, as indicated at 34. Each of the ionization sources 30, one of which is shown in detail, includes a series of chambers 21, 23, 25 and 27 and a gate valve 29 connected between space 28 and chamber 31 of the electron beam gun 32. Vacuum pumps 33 are connected to the chambers 21–27 and 31 to provide differential pumping between the pressure of about $10^{-4}$ and a pressure between about 50 Torr and 760 Torr maintained in the space 28. The ionization sources 30 provide ionizing electron beams 61 from the electron beam 31 to the space 28. A source 36 of helium gas is connected through valve 38 by line 40 to supply the helium to the space 28. A heat exchanger 37 is connected in the line 40 for cooling the helium. A helium purifier 39 is connected through pump 41 and valve 43 on line 45 to the space 28 and line 40 for recirculation, cooling, and purification of the helium. A vacuum system 47 is connected to space 28 on line 49 through valve 51 for maintaining a pressure less than atmospheric in the space 28. A heat exchanger 53 is connected to coils 55 in the space 28 through lines 57 for cooling the space 28. An electronic unit 42 under test is inside the anechoic chamber 22, and is coupled to a test system 44 by transmission antenna 46 and reception antenna 48. The test system 44 is also connected to the electron beam source 32 through a synchronizer 52 and power supplies/control circuits 54 by line 50. If discrete pulses are supplied to the source 32 from the synchronizer 52, the helium plasma is intermittently energized, and if the pulses from the synchronizer 52 are overlapped, the helium plasma is continuously energized. The test system 44 includes an analyzer sampling head 56 connected to the transmission and reception antennae 46 and 48 and a network analyzer 58 connected to the sampling head 56 by cable 59.

In operation of the system 20, helium is supplied to the space 28 from the source 36. The ionization sources 30 generate a helium plasma in the space 28 by pulsed operation of the electron beam source 32. Timing signals are supplied by the synchronizer 52 to the electron beam source 32 and the test system 44 on line 50, so that test signals are supplied by the test system 44 to the unit 42 under test on line 46 and outputs from the unit 42 are supplied to the test system 44 during an approximately 200 μsecond low-noise portion of the helium plasma afterglow following energization of the ionization sources 30. Electromagnetic waves generated by the unit 42 in the chamber 22 during the test are absorbed by the helium plasma, so that the outputs from the unit 42 do not include any substantial interference from reflected electromagnetic waves in the chamber 22. In practice, the system 20 should give an overall power reflection coefficient at least 40 dB lower than a conventional anechoic chamber having foam electromagnetic wave absorbers mounted on its walls.

C. Ionization Techniques

To utilize a helium plasma as an absorber, the electron density must decrease with increasing range from the source. If this variation is like $1/r^2$, then the backscatter reflection coefficient from the plasma is small but absorption from the plasma remains high. Although there are many ways to ionize a plasma, electron-beam and x-rays sources do the job in a simple direct manner. X-rays generate ionizing radiation that varies as $1/r^2 \exp(-r/r_m)$, where $r_m$ is the mean range for the ionizing radiation. Electron-beam ionization yields an electron density variation similar to that for X-rays, but cuts off more quickly for $r>r_m$.

The efficiency of generating an electron-beam is nearly 100%. The downside factors that apply to an electron-beam source are (1) the prompt electrical noise associated with the discharge and (2) the current loading and efficiency of the transmission window. The electromagnetic noise (Bremsstrahlung emissions) due to charge transport were estimated and found to be negligible. Bekefi, G. *Radiation Process in Plasmas*, Chapter 5, (Wiley, 1966); and Ingraham, J. C. and Brown, S. C., "Helium Afterglow and Decay of the Electron Energy," *Physical Review*, Vol. 138, No. 4A, pp. A1015–A1022, (May, 1966) discuss electrical noise in plasma afterglow. For the plasmas considered here the electrical noise temperature would be ~1000° K. in the afterglow. This noise temperature is negligible compared to the $10^{6\circ}$ K. noise temperature that typifies a state-of-the art network analyzer such as an HP 8510A/B.

Proper shielding techniques and conducting experiments during the helium afterglow mitigate the radio frequency interference (RFI) generated by an electron beam. The current loading and efficiency of the transmission window is a serious consideration for CW operation, but not for intermittent operation.

An X-ray source is virtually the same as an electron-beam source except that the transmission window is replaced by a conversion plate to generate X-rays. The efficiency of a thin conversion plate is 10% for an applied voltage of 500 kV. The conversion efficiency is roughly proportional to applied voltage. The important difference between X-ray and electron-beam sources is the lack of charge transport in the plasma during X-ray ionization. This reduces the RFI generated by the plasma. This lower RFI level may be worth the additional power required to operate an X-ray source.

D. Absorption-Reflection Sequence

Consider a wave propagating towards an ionization source. As the wave nears the source the electron number density increases as the distance to the source (r) decreases. At an electron density for which the plane-wave frequency (f) equals the plasma frequency ($f_p$), wave reflection is possible. The reflection coefficient for a plasma is an involved calculation. Fresnel reflection theory dictates that a wave will reflect from slab-like discontinuities. But, the sources suggested above have gentle gradients that do not provide simple slabs for coherent backscatter. The backscatter process is a continuous one distributed along the electron density profile. As the wave advances toward the ionization source, it attenuates and incoherently backscatters.

The Chesnut report cited above calculates the power reflection coefficient from VHF to L-band to be of the order of $10^{-10}$ (−100 dB), for typical operational parameters suitable for the system of this invention. Chesnut calculated the backscatter reflection coefficient for an Epstein profile defined by $$n(r) = \frac{n_o}{1 + \exp(-r/\delta)} \quad (2)$$

where δ is approximated by the mean range, $r_m$, of the ionization source. The reflection coefficient is a sensitive function of the electron density gradient. Reducing this gradient by a factor of two lowers the reflection coefficient by five orders of magnitude (to $10^{-15}$), −150 dB.

A plasma approximately two to four wavelengths thick may provide adequate attenuation and a small reflection coefficient. If the reflection coefficient is not small enough, the energy of the ionization source can be increased. This increases the plasma thickness and requires more power, but shifts the region of attenuation to a greater range from the source where the gradient in $n_e$ is less severe. This gentler variation in $n_e$ implies a much lower reflection coefficient, according to Chesnut. The power-reflection coefficient can be controlled by selecting an appropriate mean range for ionization ($r_m$).

E. Technical Feasibility

A helium plasma broadband electromagnetic absorption system as described above has been determined to be feasible by computation and by experiment. The helium plasma system must provide adequate attenuation, operate at a reasonable power level and not introduce any unusual operating conditions. The theoretical basis for predictions of absorption by a collisional plasma is firm. Key operational parameters, such as power required and ionization source operating potential, have been evaluated by computation. The total number of electrons, $N_T$, required per square meter of absorber is computed by applying the formulas cited by Budden for an Epstein profile and integrating exp(-ikr) for this profile to assure adequate round trip absorption for the chamber's interior walls. The value of $N_T$ and $r_m$ are adjusted to provide the required attenuation. In Table 1 this absorption is set at 80 dB. FIGS. 4, 5 and 6 quantify performance at 760, 200 and 50 mm Hg.

The energy required is $N_T \times 42$ eV for helium. The CW power required is this energy divided by the electron lifetime. The average power required is the CW power multiplied by the duty ratio, $R_d$, divided by the source ionization efficiency, ϵ. This power is a function of air as an impurity, ionization source efficiency, and the duty ratio. Calculated estimates for a helium absorber with air as an impurity expressed in units of parts per million (ppm) appear below in Table 1.

TABLE 1

AVERAGE POWER PER $M^2$ FOR 80 DB ABSORPTION

| | PRESSURE IN CHAMBER | | |
|---|---|---|---|
| $D_r/\epsilon$ | 760 mm Hg | 200 mm Hg | 50 mm Hg |
| 10 | 240 KW | 30 KW | 4 KW |
| 1 | 24 KW | 3 KW | 400 W |
| 0.1 | 2.4 KW | 300 W | 40 W |
| 0.01 | 240 W | 30 W | 4 W |

DATA: Helium with 100 ppm air as an impurity. Electron lifetime: 110 μs at 760 mm Hg, 270 μs at 200 mm Hg, and 550 μs at 50 mm Hg. $D_r$ is the duty ratio, and ϵ is the source ionization efficiency.

The operating potential for the ionization source depends on the mean range, $r_m$, necessary to minimize plasma backscatter. Table 2 contains calculated estimates based on mass attenuation coefficients for helium.

TABLE 2

MEAN RANGE OF IONIZATION SOURCES

| SOURCE POTENTIAL KV | MEAN RANGE IN METERS ELECTRON BEAM |
|---|---|
| 20 | 0.05 |
| 40 | 0.17 |
| 60 | 0.34 |
| 80 | 0.57 |
| 100 | 0.84 |
| 150 | 1.65 |
| 200 | 2.64 |
| 300 | 4.95 |
| 400 | 7.62 |
| 500 | 10.44 |

The estimated operational parameters suggest feasibility for operation conducted with a modest $R_d/\epsilon$ value of 0.1 to 0.01 and air as a helium impurity limited to no more than 100 ppm. An electron-beam source would operate at a potential between 20 kV and 300 kV. For a duty ratio of 0.01 the electron beam current would be less than 10 ma. Although these parameters suggest feasibility, an acceptable absorber must have a low reflection coefficient and generate little noise. The afterglow plasma has a noise temperature of ~1000° K.

Figure 3:
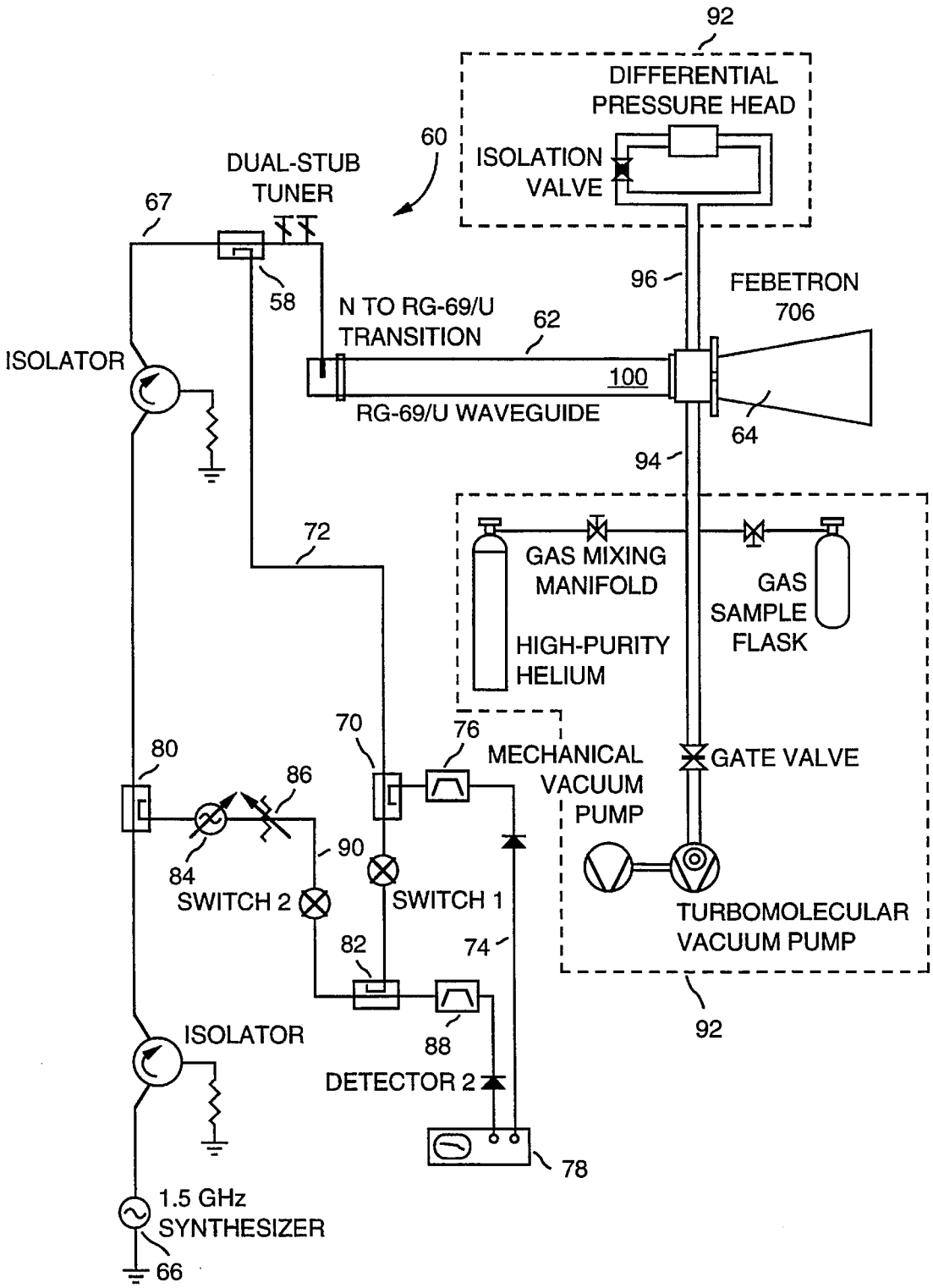
FIG. 3 is a block diagram of another embodiment of an experimental electromagnetic wave absorption system in accordance with the invention.

FIG. 3 shows the experimental system 60 which was used to measure these two parameters. The system 60 includes a waveguide 62 having an electron beam ionization source 64 at one end and an electromagnetic transmitter 66 connected at the other end by line 67. Directional couplers 58 and 70 feed a backscattered signal on lines 72 and 74 through band-pass filter 76 to an oscilloscope receiver 78. Third and fourth directional couplers 80 and 82 supply the input signal from transmitter 66 through phase shifter 84, variable attenuator 86 and band-pass filter 88 on line 90 as a reference input to the oscilloscope receiver 78. Supply system 92 is connected by tubes 94 and 96 to feed helium, air or helium mixed with air to the waveguide 62.

In operation of the system 60, chamber 100 of the waveguide 62 is filled with helium, air or a helium-air mixture. The electron beam source is intermittently energized to form a collisional plasma from the gas in the chamber 100 in the same manner as in the FIG. 2 system 20. The transmitter 66 supplies an input signal to the waveguide 62 during the plasma afterglow, which is in part absorbed by the plasma in chamber 100 and in part backscattered for measurement by the oscilloscope receiver 78. A number of measurements are made with different gas mixtures, applied energies and operating potentials to quantify the key operating parameters.

In the experiments, the electron beam source 64 was operated at 600 kV, 330 Amps, 50 nsec pulses, and 10 Joules. Gases used to form the collisional plasma were laboratory air, helium mixed with 100 ppm air, and pure helium with ≦1 ppm air. Measurements were taken at gas pressures of 700, 500, 300, 200, 100, 50 and 20 Torr. Measurements were taken at a signal input frequency of 1.5 GHz and a reflectivity dynamic range of 25–30 dB. The results obtained are shown in the following tables and in FIGS. 7–9.

The NET RETURN in FIGS. 7–9 refers to the total signal backscattered from the plasma afterglow and reflected from the untimivated end of the waveguide. Prior to the imagination pulse at t=0 the reflectivity of the helium afterglow was normalized to 0 dB, i.e., the reflectivity of the untimivated waveguide.

Table 3 is a comparison between experimental and theoretical predictions of electron lifetime. The column headed as extinction refers to the period that a network analyzer could operate before the plasma requires reionization.

TABLE 3

RESULTS FOR HELIUM WITH 100 PPM AIR

| PRESSURE | ELECTRON LIFETIME | | EXTINCTION | |
|---|---|---|---|---|
| TORR | THEORY | EXP | THEORY | EXP |
| 700 | 39 μS | 110 μS | 35 μS | 51 μS |
| 500 | 67 μS | 150 μS | 65 μS | 73 μS |
| 300 | 160 μS | 230 μS | 150 μS | 140 μS |
| 200 | 300 μS | 270 μS | 260 μS | 200 μS |
| 100 | 950 μS | 350 μS | 650 μS | 380 μS |
| 50 | 2.2 mS | 550 μS | 1.4 mS | 690 μS |
| 20 | 4.1 mS | 1.4 mS | 1.5 mS | 390 μS |
| 10 | 2.3 mS | 1.0 mS | 430 μS | 370 μS |

Data: Electron lifetime inferred from curves between the absorption minimum and 15 dB attenuation. Extinction refers to the time interval following plasma generation that the net return was less than 27 dB.

FIGS. 7–9 illustrate absorption vs. time as observed during the experiment at pressures of 700, 200 and 50 mm Hg. Note the sudden onset of profound attenuation and a recovery in less than a millisecond. This quick onset and recovery suggest additional applications as a switchable absorber.

It should now be readily apparent to those skilled in the art that a novel broadband electromagnetic wave absorption system and process capable of achieving the stated objects of the invention has been provided. The system and process makes practical use of the electromagnetic wave absorbing properties of a helium collisional plasma to give absorption over a wider frequency range than achieved with conventional electromagnetic energy absorbers. The long afterglow of a helium collisional plasma means that the helium may be energized intermittently to create the plasma, with the system being used during the low noise afterglow period. In particular, the desirable features of the system and process make it useful as an energy absorbing system in an anechoic chamber. Those features should make the system and process of value in a wide variety of other applications, as well.

It should further be apparent to those skilled in the art that various changes in form and details of the invention as shown and described may be made. For example, a flexible membrane may enclose the helium absorber which can then be used to fill cavities/voids and so provide a switchable absorber. It is intended that such changes be included within the spirit and scope of the claims appended hereto.

What is claimed is:

1. An electromagnetic wave absorption system for absorbing electromagnetic waves over a frequency range from about 100 megahertz through about 10 gigahertz, which comprises a vessel for confining a body of helium gas, means for supplying helium gas to said vessel and maintaining said gas at a pressure from about atmosphere (750 mm of Hg) to about 10 torr, and at least one ionization source coupled to said vessel for ionizing the helium gas to produce a plasma.

2. The electromagnetic wave absorption system of claim 1 in which said ionization source is powered to supply ionizing energy to the helium gas continuously, or intermittently to provide a switchable absorber.

3. The electromagnetic wave absorption system of claim 2 additionally comprising means for producing an electromagnetic wave positioned to supply the electromagnetic wave to said vessel and means coupled to said means for producing an electromagnetic wave for controlling the means for producing an electromagnetic wave to supply the electromagnetic wave when said ionization source is not supplying ionizing energy to said ionization source.

4. The electromagnetic wave absorption system of claim 1 additionally comprising means for supplying an electromagnetic wave to said vessel.

5. The electromagnetic wave absorption system of claim 4 in which said means for supplying an electromagnetic wave comprises an electronic unit in said vessel.

6. An electromagnetic wave absorption system which comprises an anechoic chamber, a vessel for confining a body of helium gas located on walls of said anechoic chamber, means for supplying helium gas to said vessel, and a plurality of said ionization sources mounted on the walls of the anechoic chamber coupled to said vessel for ionizing the helium gas to produce a plasma.

7. The electromagnetic wave absorption system of claim 6 in which said ionization source is powered to supply ionizing energy to the helium gas continuously, or intermittently to provide a switchable absorber.

8. The electromagnetic wave absorption system of claim 7 additionally comprising means for producing an electromagnetic wave positioned to supply the electromagnetic wave to said vessel and means coupled to said means for producing an electromagnetic wave for controlling the means for producing an electromagnetic wave t0 supply the electromagnetic wave when said ionization source is not supplying ionizing energy to said ionization source.

9. The electromagnetic wave absorption system of claim 1 in which said ionization source comprises an electron beam source.

10. The electromagnetic wave absorption system of claim 1 in which the helium gas from said means for supplying helium gas contains up to about 100 parts per million of air.

11. A process for absorbing an electromagnetic wave having a frequency from about 100 megahertz through about 10 gigahertz, which comprises confining a body of helium gas, maintaining said body of helium gas at a pressure from about atmospheric to about 10 torr, ionizing the body of helium gas to produce a plasma, and absorbing the electromagnetic wave with the plasma of the body of helium gas.

12. The process of claim 11 in which the body of helium gas is ionized by supplying ionizing energy to the body of helium gas continuously, or intermittently to provide a switchable absorber.

13. The process of claim 12 additionally comprising positioning a means for producing an electromagnetic wave to supply the electromagnetic wave to the body of helium gas and controlling the means for producing an electromagnetic wave to supply the electromagnetic wave when ionizing energy is not being supplied to the body of helium gas.

14. The process of claim 11 additionally comprising positioning a means for producing an electromagnetic wave to supply the electromagnetic wave to the body of helium gas.

15. The process of claim 14 in which the means for producing an electromagnetic wave comprises an electronic unit surrounded by the body of helium gas.

16. The process of claim 11 in which the body of helium gas is located on walls of an anechoic chamber.

17. The process of claim 16 in which ionizing energy is supplied to the body of helium gas continuously, or intermittently to provide a switchable absorber.

18. The process of claim 17 additionally comprising positioning a means for producing an electromagnetic wave in the form of an electronic unit to be tested in the anechoic chamber and controlling the electronic unit to supply the electromagnetic wave when the ionizing energy is not being supplied to the body of helium gas.

19. The process of claim 11 in which the ionizing energy is an electron beam.

20. The process of claim 11 in which the body of helium gas contains up to about 100 parts per million of air.

* * * * *